US008196602B2

(12) United States Patent
Korzeniowski

(10) Patent No.: US 8,196,602 B2
(45) Date of Patent: Jun. 12, 2012

(54) WATER DISTRIBUTION SYSTEM FOR COLD CLIMATES

(76) Inventor: Jan A. Korzeniowski, Calgary (CA)

( * ) Notice: Subject to any disclaimer, the term of this patent is extended or adjusted under 35 U.S.C. 154(b) by 361 days.

(21) Appl. No.: 12/484,872

(22) Filed: Jun. 15, 2009

(65) Prior Publication Data

US 2010/0180964 A1 Jul. 22, 2010

(51) Int. Cl.
*E03B 7/12* (2006.01)
*E03B 7/00* (2006.01)

(52) U.S. Cl. ..... 137/563; 137/565.11; 137/565.16; 417/44.2; 138/30

(58) Field of Classification Search ..... 137/563, 137/565.11, 565.13, 565.16; 417/44.2; 138/30
See application file for complete search history.

(56) References Cited

U.S. PATENT DOCUMENTS 1,566,591 A * 12/1925 Goldsmith et al. ..... 417/44.9
2,692,798 A * 10/1954 Hicks ..... 137/563
3,103,946 A * 9/1963 Troxell ..... 137/563
3,593,744 A * 7/1971 Smith ..... 138/30
4,653,532 A * 3/1987 Powers ..... 137/563
5,032,290 A * 7/1991 Yamagata et al. ..... 137/563
5,476,118 A * 12/1995 Yokoyama ..... 137/563
6,062,259 A * 5/2000 Poirier ..... 137/563
6,345,644 B1 * 2/2002 McLeod ..... 137/563
6,463,956 B2 * 10/2002 Walker ..... 137/563
6,705,344 B2 * 3/2004 Poirier ..... 137/563
7,089,955 B1 * 8/2006 Komro, Sr. ..... 137/563
7,316,243 B2 * 1/2008 Honeymann et al. ..... 137/563

* cited by examiner

*Primary Examiner* — John Rivell

(57) ABSTRACT

The Water Distribution System is specifically applicable in cold climates in which water distribution systems may be subjected to freezing during the winter months.

The Water Distribution System is applicable to domestic, industrial, recreational and institutional water distribution systems including water transmission and distribution mains and service connections.

The Water Distribution System has applications in specific terrain and climatic conditions such as high bedrock, high groundwater table and permafrost.

The Water Distribution System may, in specific terrain and climatic conditions, use uninsulated or insulated water mains and service connections, but without heat tracing or water bleeding in any case.

The Water Distribution System is applicable to single and multiple complex distribution pipe systems arranged as parallel or looped, or combination of both arrangements.

The system design is simple, practical and economical when compared to conventional design of insulated and heat traced pipes or deep burry installations, or water bleeding to prevent freezing.

8 Claims, 2 Drawing Sheets

WATER DISTRIBUTION SYSTEM FOR COLD CLIMATES

FIELD OF THE INVENTION

The invention is a system for water distribution in cold climates in which water transmission and distribution mains, and service connections may be subjected to freezing.

BACKGROUND OF THE INVENTION

Water Distribution Systems in cold climates need to be designed to prevent freezing and this includes water transmission and distribution mains and service connections.

Water mains and service connections are designed as uninsulated deep bury, below the freezing level, or insulated deep burry, or insulated and heat traced shallower installations. Any of the above three solutions is expensive and often difficult to implement in terrains with high bedrock elevations or high ground water table.

Similar, but even more difficult conditions, are created by permafrost in which case water mains can be installed below or above the permafrost level or above ground. In each case, water mains need to be insulated and heat traced. The aboveground installations often require additional protection against mechanical injuries. Insulated "box like", "utilidoors", are often used for aboveground installations.

Another solution to prevent freezing of water mains and service connections is bleeding of service lines at buildings through taps. This may be required even in cases where water mains and service connections insulation and heat tracing is not adequate or damaged.

The service lines bleeding results in a waste of domestic water and in increase of sewage flows, and in decrease of sewage biological loading which have negative impacts on the sewage treatment systems.

Any of the above cases lead to an expensive installation and operation, low reliability of the operation and extensive maintenance of the water distribution systems.

The invention eliminates the problems associated with the conventional designs outlined above and it is less expensive to install and operate, and it provides a high reliability and less maintenance of the water distribution systems in cold climates.

The invention does not require water mains and service connections to be heat traced or be installed very deep.

The water mains and service connections can be shallow burry insulated or uninsulated depending on specific climatic, terrain and development conditions including temperature, soil type, groundwater level, snow cover, type of development (single family, multi family, industrial, recreational, institutional buildings), density of development and water use.

The invention leads to a lower power consumption than the conventional insulated and heat traced systems or service lines bleeding to prevent freezing and it does not result in negative impacts on the sewage flows and biological composition.

The invention is applicable to small and large water distribution systems consisting of single or multiple distribution mains and looped or independent, parallel not looped water mains.

BRIEF SUMMARY OF THE INVENTION

The water distribution system of the present invention is a process for water distribution in cold climates where water mains and service connections have to be buried deep or be insulated and heat traced to prevent freezing.

The water distribution system as shown in FIG. 1 and FIG. 2 applies to single or parallel not looped water distribution mains with service connections and to looped distribution mains with service connections of various extent and complexity of the water mains arrangement.

The water distribution system of the present invention basic components comprise a water pumping system, a water storage reservoir, water distribution mains with service connections, hydropneumatic tanks installed at the service connections in buildings and water relief system from the distribution mains to the water storage reservoir.

The water distribution system operates in a cyclic pumping of water to the distribution system and relief of the water from the distribution system to the storage reservoir.

Single or multiple water pumping, storage reservoir and water relief systems can be designed for a distribution system depending on the system extent and complexity.

The multiple water pumping, storage and relief systems can operate individually or jointly.

The water pumping and relief operation results in a continuous movement and pressure change of water in the distribution system and service connections regardless of the water use by the consumers including night hours when the water use is negligible or there is not any water use at all. This is specifically essential for service connections which are, of small diameter which are subject to freezing in a short period of time during the winter months or throughout the year in permafrost.

The water movement (flow) and pressure changes are adjustable depending on the distribution system extent and size of distribution mains and service connections. A typical pressure change may be in the range of 0.8 to 2 bars (12 to 30 psi).

BRIEF DESCRIPTION OF THE SEVERAL VIEWS OF THE DRAWING

Having thus generally described the invention, it will be referred to more specifically by reference to accompanying drawings illustrating preferred embodiments and in which.

DETAILED DESCRIPTION OF THE INVENTION

Figure 1:
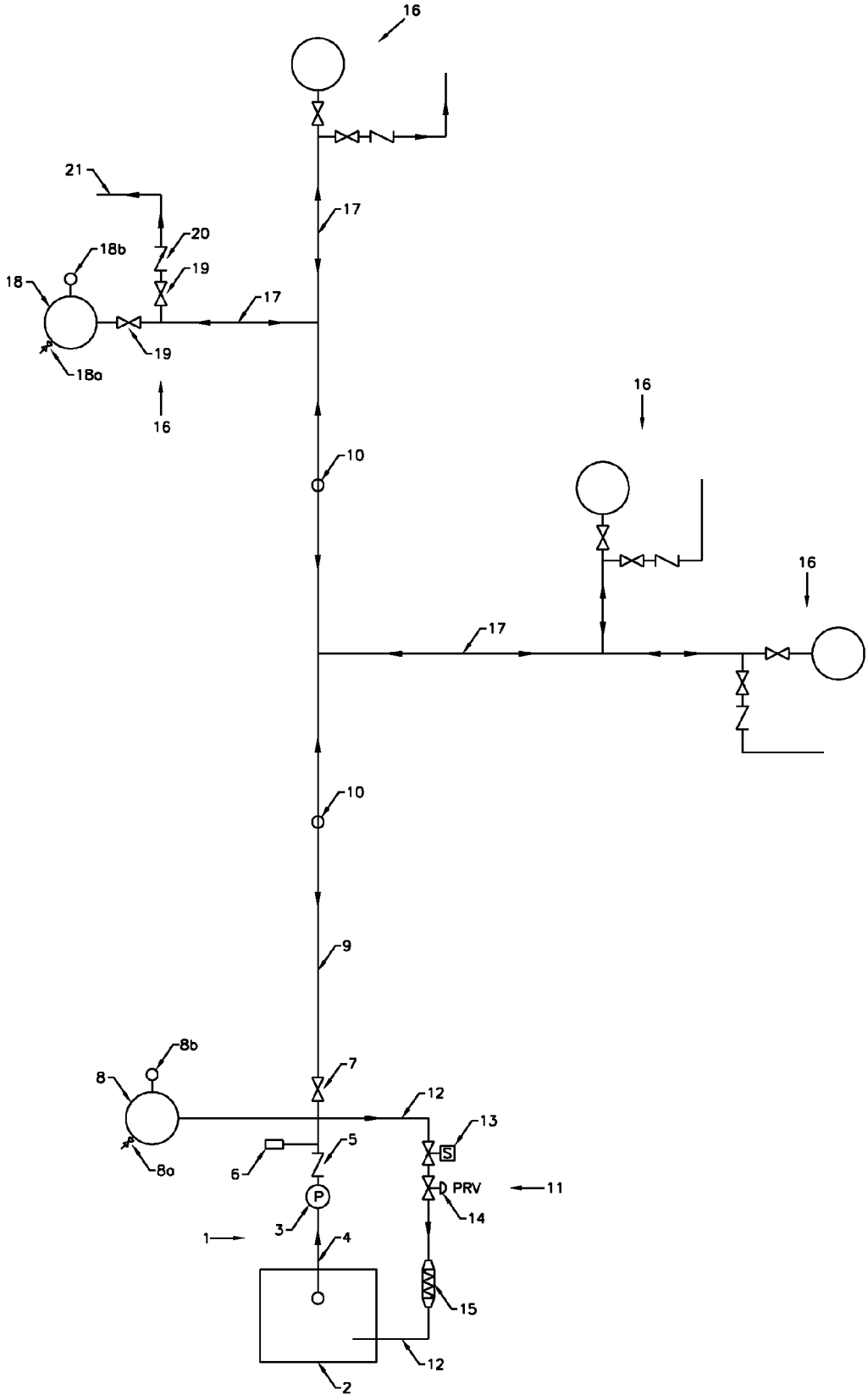
FIG. 1 is a diagrammatic illustration of a single water main distribution system with service connections.

According to the embodiment of the invention, as shown on FIG. 1, the water distribution system comprises: a water pumping system 1, a water storage reservoir 2, a water distribution main 9, a water relief system 11 and a water service connection system 16.

The water pumping system 1 comprises a water pump 3, a water inlet pipe 4, a non-return valve 5, a pressure indicator/switch 6, a shut off valve 7, a hydropneumatic tank 8.

The water distribution main 9 may include fire hydrants 10.

The water relief system 11 comprises an automatic open/close control valve 13, a pressure sustaining valve 14, a rate of flow control valve 15, and a by-pass pipe 12.

The water connection system 16 comprises a water service pipe 17, a hydropneumatic tank 18, shut off valves 19, a non-return valve 20 and a water connection pipe to plumbing fixtures 21.

The hydropneumatic tanks 8 and 18 are provided with a rubber/plastic diaphragm to separate the air and water contained in the tanks and preferably a connection for an air compressor 8*a* and a pressure gauge 8*b*.

The hydropneumatic tank 8 is preferred but not mandatory, but the hydropneumatic tanks 18 are mandatory for all service connection systems 16.

The hydropneumatic tank systems 16 are preferably provided with shut off valves 19 and a non-return valve 20.

The pumping system 1 operates in a cyclic mode "on/off" and the pump 3 start and stop operation is controlled by the pressure indicator/switch 6 within a pre-set pressure range which may be 3 to 5 bars (45-75 psi).

The pumping system 1 operates in conjunction with the pressure relief system 11.

When the pump 3 starts the automatic control valve 13 is closed and when the pump 3 stops the automatic control valve 13 is open.

When the pump 3 operates the distribution system water pressure rises to a pre-set level and when the pump 3 operation is stopped the distribution water pressure drops to a pre-set level, as the distribution water is released from the distribution system to the water storage reservoir 2 through the pressure relief system 11.

When the water pump 3 operates and the water distribution system pressure rises, the hydropneumatic tanks 8 & 18 are filled with water and when the water pump 3 stops and the pressure relief system 11 is open the water flows out of the hydropneumatic tanks 8 & 18 and the entire distribution system to the storage reservoir 2. Thus, there is a continuous water flow into or out of the distribution main 9 and the service connection system 16. This prevents the water main 9 and the service connection 17 from freezing.

The pressure sustaining valve 14 is not mandatory but it is preferred to ensure that the water distribution system pressure is not excessive or too low in case of a malfunction of the pressure indicator/switch 6 and the automatic control valve 13.

Also, the rate of flow control valve 15 is not mandatory but it is preferred to control the rate of flow of the water from the distribution system to the storage reservoir 2.

The water storage reservoir 2 provides water for the distribution system and temporarily stores the water released from the distribution system.

Figure 2:
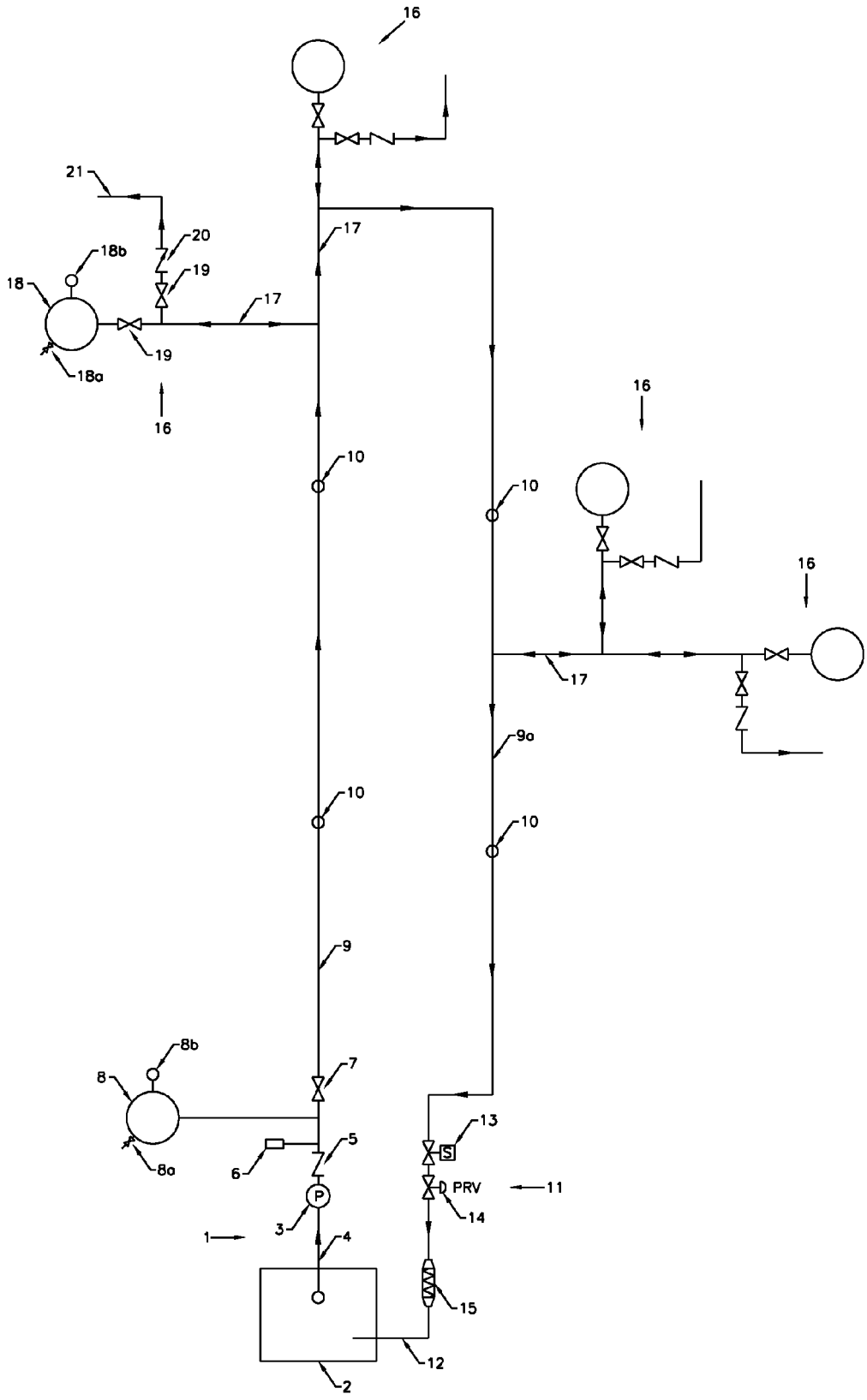
FIG. 2 is a diagrammatic illustration of a two-main looped water distribution system with service connections.

A second embodiment of the invention is shown on FIG. 2.

For the various embodiments disclosed here the same reference numeral numbers are used for the same or substantially similar features.

The water distribution mains 9 & 9*a* are arranged in a loop system in which water is pumped from the storage reservoir 2 into the distribution system through one leg of the loop, water main 9, and released from the distribution system to the storage reservoir 2, through the second leg of the loop, water main 9*a*.

In this arrangement of the water mains 9 & 9*a* the distribution water always flows in the same direction, from the pumping system 1 to the water relief system 11 regardless of the pump 3 operating status, but the water flow in the service connection systems 16 is in two directions as in the embodiment shown on FIG. 1.

The above description is intended in an illustrative rather than a restrictive sense, and variations to the specific configurations and appurtenances described may be apparent to skilled persons in adapting the present invention to other specific applications. Such variations are intended to form part of the present invention insofar as they are within the spirit and scope of the claims below.

The invention claimed is:

1. A water distribution system comprising:

a water pumping system, a water storage reservoir, a water distribution main, a water service connection system and a water relief system;

said water pumping system comprises a water pump and a pressure indicator/switch which operates said water pump in a cycling mode between operation and idle; and said water relief system comprises an automatic, open/close, control valve fluidly connected between said main and said reservoir, said control valve is closed when the said water pump is in operation and said control valve is open when said water pump is idle.

2. The water distribution system of claim 1 wherein said pressure indicator/switch controls said pump operation within a pre-set pressure range.

3. The water distribution system of claim 1 wherein said water service connection system comprises a water service pipe and a hydropneumatic tank with a rubber or plastic diaphragm separating water and air contained in the hydropneumatic tank.

4. The water distribution system of claim 3 wherein said hydropneumatic tank is connected to said water service pipe in such a way to allow water flow from said service pipe into said hydropneumatic tank and from said hydropneumatic tank into said water service pipe.

5. The water distribution system of claim 1 wherein said automatic control valve releases water from said distribution main to said storage reservoir during the time said automatic control valve of is open.

6. The water distribution system of claim 5 wherein said water storage reservoir functions as a daily water consumption fluctuation balancing storage reservoir and a temporary water storage reservoir for water released from the distribution system through said automatic control valve.

7. The water distribution system of claim 1 wherein said water distribution main comprises a single water main and/or multiple water mains not looped together and/or multiple water mains looped together.

8. The water distribution system of claim 3 wherein said water distribution main has said service connections connected throughout the length of and at the end of said water distribution main.

* * * * *